US010443629B2

(12) United States Patent
Kondo et al.

(10) Patent No.: US 10,443,629 B2
(45) Date of Patent: Oct. 15, 2019

(54) OPERATION DEVICE AND HYDRAULIC SYSTEM

(71) Applicant: KAWASAKI JUKOGYO KABUSHIKI KAISHA, Kobe-shi, Hyogo (JP)

(72) Inventors: Akihiro Kondo, Kobe (JP); Hiroaki Shimizu, Akashi (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 113 days.

(21) Appl. No.: 15/821,911

(22) Filed: Nov. 24, 2017

(65) Prior Publication Data

US 2018/0142709 A1 May 24, 2018

(30) Foreign Application Priority Data

Nov. 24, 2016 (JP) ..... 2016-227673

(51) Int. Cl.
*F15B 11/10* (2006.01)

(52) U.S. Cl.
CPC ..... *F15B 11/10* (2013.01); *F15B 2211/20546* (2013.01); *F15B 2211/255* (2013.01); *F15B 2211/6316* (2013.01); *F15B 2211/6346* (2013.01); *F15B 2211/6654* (2013.01); *F15B 2211/6656* (2013.01)

(58) Field of Classification Search
CPC ..... F15B 11/10; F15B 2211/255; F15B 2211/6316; F15B 2211/6346; F15B 2211/6656; F15B 13/0424
USPC ..... 60/459
See application file for complete search history.

(56) References Cited

U.S. PATENT DOCUMENTS

2017/0241447 A1* 8/2017 Boulard ..... A01B 76/00

FOREIGN PATENT DOCUMENTS

JP H11-140911 A 5/1999
JP 2015-175174 A 10/2015

* cited by examiner

*Primary Examiner* — Michael Leslie
*Assistant Examiner* — Daniel S Collins
(74) *Attorney, Agent, or Firm* — Oliff PLC

(57) ABSTRACT

An operation device includes: an operating unit; a pilot valve that outputs a pilot pressure corresponding to an operating amount of the operating unit; an operating amount detection sensor that outputs an operating amount signal corresponding to the operating amount of the operating unit; a first bar code provided on the pilot valve and containing pilot pressure actual measurement information indicating a relationship between the operating amount of the operating unit and an actual measurement value of the pilot pressure outputted from the pilot valve; and a second bar code provided on the pilot valve and containing operating amount signal actual measurement information indicating a relationship between the operating amount of the operating unit and an actual measurement value of the operating amount signal outputted from the operating amount detection sensor.

5 Claims, 3 Drawing Sheets

OPERATION DEVICE AND HYDRAULIC SYSTEM

BACKGROUND OF THE INVENTION

1. Field of the Invention

The present invention relates to an operation device used in a hydraulic circuit and a hydraulic system including the operation device.

2. Description of the Related Art

Conventionally, an operation device for operating an actuator is used in a hydraulic circuit. Hydraulic oil is supplied to the actuator from a pump via a control valve, and the operation device moves the control valve to change the amount of hydraulic oil supplied to the actuator.

For example, Japanese Laid-Open Patent Application Publication No. 2015-175174 discloses an operation device that outputs a pilot pressure and an electrical signal. The pilot pressure is used for moving a control valve, and the electrical signal is used for adjusting the discharge flow rate of a pump.

Specifically, the operation device disclosed in Japanese Laid-Open Patent Application Publication No. 2015-175174 includes an operating unit, a pilot valve, an operating amount detection sensor, an operating amount signal calculator, and an operating amount signal outputter. The pilot valve outputs a pilot pressure corresponding to an operating amount of the operating unit. The operating amount detection sensor outputs an operating amount detection signal corresponding to the operating amount of the operating unit. The operating amount signal calculator is intended for correcting non-uniformity in the characteristics of the operation device due to manufacturing errors or the like. Specifically, by using a conversion table that is based on actual measurement data, the operating amount signal calculator converts the operating amount detection signal detected by the operating amount detection sensor into an operating amount signal that is a signal when a design-value pilot pressure is outputted from the pilot operation valve. The operating amount signal outputter outputs, as an electrical signal, the operating amount signal generated by the operating amount signal calculator.

SUMMARY OF THE INVENTION

The operation device disclosed in the above Patent Literature 1 requires, in addition to the operating amount detection sensor, an electronic circuit that forms the operating amount signal calculator and that includes, for example, means for storing information in which the operating amount detection signal is associated with the operating amount signal. For this reason, the cost of the operation device is high. In addition, the installation position of the electronic circuit on the pilot valve is limited, and wiring is required between the operating amount detection sensor and the electronic circuit.

In view of the above, an object of the present invention is to provide an operation device capable of correcting non-uniformity in the characteristics of the operation device due to manufacturing errors or the like without installing any electronic circuit on a pilot valve, and a hydraulic system including the operation device.

In order to solve the above-described problems, an operation device of the present invention includes: an operating unit; a pilot valve that outputs a pilot pressure corresponding to an operating amount of the operating unit; an operating amount detection sensor that outputs an operating amount signal corresponding to the operating amount of the operating unit; a first bar code provided on the pilot valve and containing pilot pressure actual measurement information indicating a relationship between the operating amount of the operating unit and an actual measurement value of the pilot pressure outputted from the pilot valve; and a second bar code provided on the pilot valve and containing operating amount signal actual measurement information indicating a relationship between the operating amount of the operating unit and an actual measurement value of the operating amount signal outputted from the operating amount detection sensor.

According to the above configuration, after a bar code reader has read the first bar code and the second bar code, the operating amount signal outputted from the operating amount detection sensor can be modified based on the actual measurement value of the pilot pressure and the actual measurement value of the operating amount signal. This makes it possible to correct non-uniformity in the characteristics of the operation device due to manufacturing errors or the like. In addition, since the operating amount detection sensor is the only electronic device that needs to be incorporated in the operation device, it is not necessary to install any electronic circuit on the pilot valve.

At least one of the first bar code and the second bar code may contain reading error prevention information for preventing an error when the at least one of the first bar code and the second bar code is read by a bar code reader. This configuration makes it possible to prevent an error when the at least one of the first bar code and the second bar code is read by the bar code reader even if the at least one of the first bar code and the second bar code is unclear due to, for example, smudges thereon.

For example, each of the pilot pressure actual measurement information and the operating amount signal actual measurement information may contain a plurality of actual measurement points, and the reading error prevention information may contain a plurality of imaginary points set around each of the plurality of actual measurement points.

A hydraulic system according to the present invention includes: the above operation device; a control valve that is moved by the pilot pressure outputted from the pilot valve of the operation device; a variable displacement pump that supplies hydraulic oil to an actuator via the control valve; a flow rate adjuster that adjusts a discharge flow rate of the pump; and a controller that controls the flow rate adjuster based on the operating amount signal outputted from the operating amount detection sensor of the operation device. The controller generates a map for modifying the operating amount signal outputted from the operating amount detection sensor based on the first bar code and the second bar code that are read by a bar code reader connected to the controller.

For example, the controller may store the generated map in a storage device, and when the operation device is operated, the controller may perform arithmetic operation based on the stored map.

The present invention provides an operation device capable of correcting non-uniformity in the characteristics of the operation device due to manufacturing errors or the like without installing any electronic circuit on a pilot valve.

The above and other objects, features, and advantages of the present invention will more fully be apparent from the following detailed description of a preferred embodiment with accompanying drawings.

DESCRIPTION OF THE PREFERRED EMBODIMENTS

Figure 1:
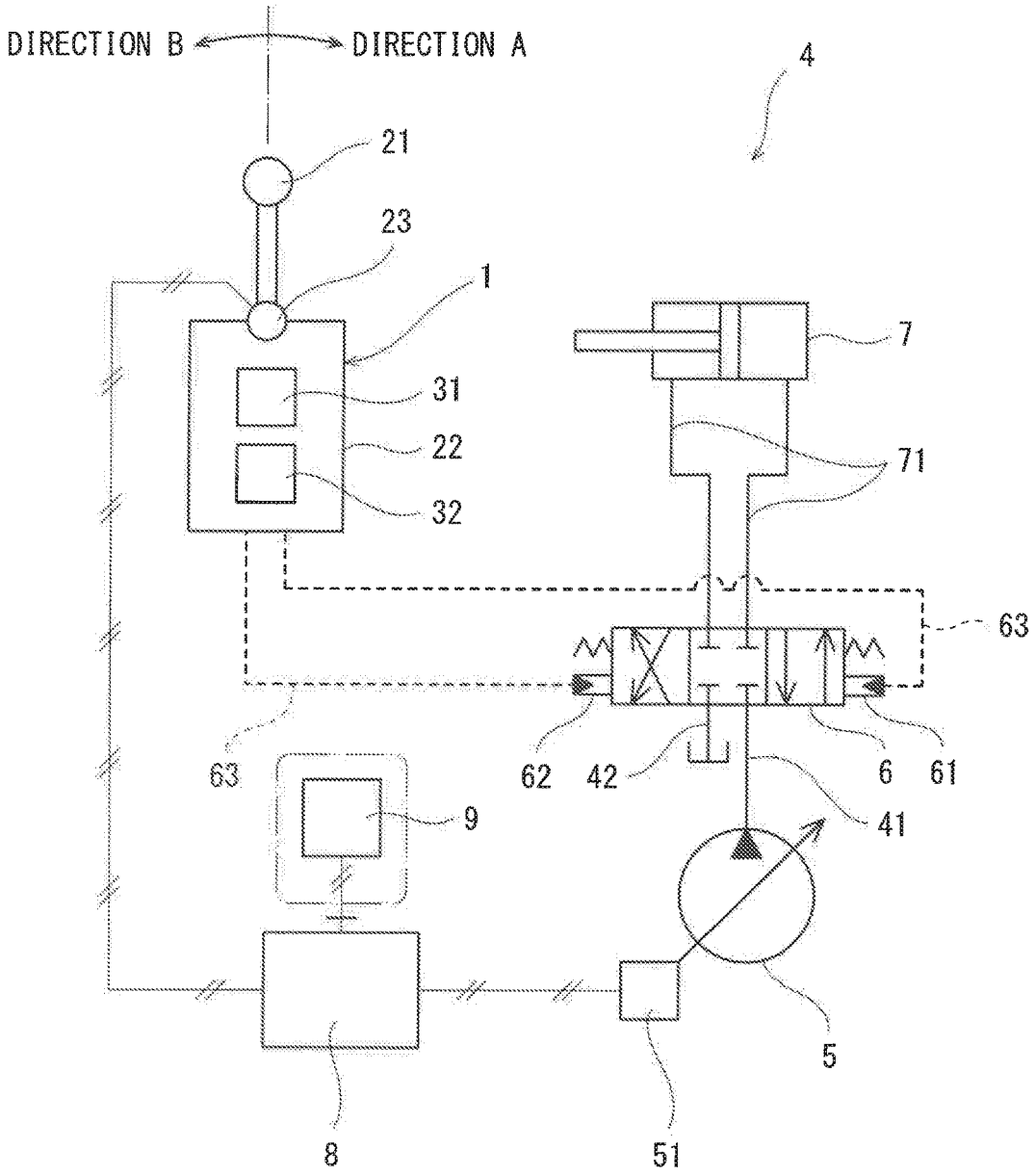
FIG. 1 shows a schematic configuration of a hydraulic system including an operation device according to one embodiment of the present invention.

FIG. 1 shows a hydraulic system 4 including an operation device 1 according to one embodiment of the present invention. In the hydraulic system 4, hydraulic oil is supplied from a pump 5 to an actuator 7 via a control valve 6.

The hydraulic system 4 may be incorporated in a construction machine, such as a hydraulic excavator or a hydraulic crane, or may be incorporated in an industrial machine. The actuator 7 may be a hydraulic cylinder, or may be a hydraulic motor.

In the present embodiment, the control valve 6 is a three-position valve that controls the supply and discharge of the hydraulic oil to and from the actuator 7. However, in a case where the actuator 7 is, for example, a single-acting cylinder that expands due to hydraulic force and contracts due to spring force or the weight of the corresponding portion, the control valve 6 may be a two-position valve that controls only the supply of the hydraulic oil to the actuator 7.

Specifically, the control valve 6 is connected to the pump 5 by a pump line 41, and connected to a tank by a tank line 42. The control valve 6 is also connected to the actuator 7 by a pair of supply/discharge lines 71.

The control valve 6 is switched between a neutral position and two movement positions. When the control valve 6 is in the neutral position, the control valve 6 blocks all the lines 41, 42, and 71 connected to the control valve 6. When the control valve 6 is in one or the other movement position, the control valve 6 allows one of the supply/discharge lines 71 to be in communication with the pump line 41 and allows the other one of the supply/discharge lines 71 to be in communication with the tank line 42. It should be noted that, depending on the intended use of the actuator 7, the control valve 6 may allow both the supply/discharge lines 71 to be in communication with the tank line 42 when the control valve 6 is in the neutral position.

To be more specific, the control valve 6 includes: a first pilot port 61 for switching the control valve 6 from the neutral position to one movement position; a second pilot port 62 for switching the control valve 6 from the neutral position to the other movement position. The control valve 6 is configured such that the meter-in opening area and the meter-out opening area increase in accordance with increase in a pilot pressure led to the first pilot port 61 or the second pilot port 62.

The operation device 1 is intended for moving the control valve 6. Specifically, the operation device 1 includes: an operating unit 21, which receives an operation from an operator; and a pilot valve 22, which outputs a pilot pressure corresponding to an operating amount of the operating unit 21. In the present embodiment, the operating unit 21 is a lever. However, as an alternative, the operating unit 21 may be a foot pedal, for example.

In the present embodiment, since the control valve 6 is a three-position valve, the pilot valve 22 outputs two types of pilot pressure. Specifically, when the lever, which is the operating unit 21, is inclined from its neutral position in one direction (Direction A in FIG. 1), the pilot valve 22 outputs a first-type pilot pressure. When the lever is inclined from the neutral position in the direction reverse to the one direction (Direction B in FIG. 1), the pilot valve 22 outputs a second-type pilot pressure. For example, in a case where the actuator 7 is a hydraulic cylinder, the first-type pilot pressure is a pilot pressure for expanding the cylinder, and the second-type pilot pressure is a pilot pressure for contracting the cylinder. It should be noted that, in a case where the control valve 6 is a two-position valve, the pilot valve 22 may output only one type of pilot pressure.

The pilot valve 22 is connected to the first pilot port 61 and the second pilot port 62 of the control valve 6 by a pair of pilot lines 63. That is, the pilot pressure outputted from the pilot valve 22 is led to the first pilot port 61 or the second pilot port 62 through one of the pilot lines 63, and the pilot pressure moves the control valve 6.

The operation device 1 further includes an operating amount detection sensor 23, which outputs an operating amount signal corresponding to an operating amount of the operating unit 21 as an electrical signal. For example, the operating amount detection sensor 23 is a potentiometer. The potentiometer may detect the inclination angle of the lever, which is the operating unit 21, or may detect the stroke position of a spool that is a component of the pilot valve 22.

Figure 3:
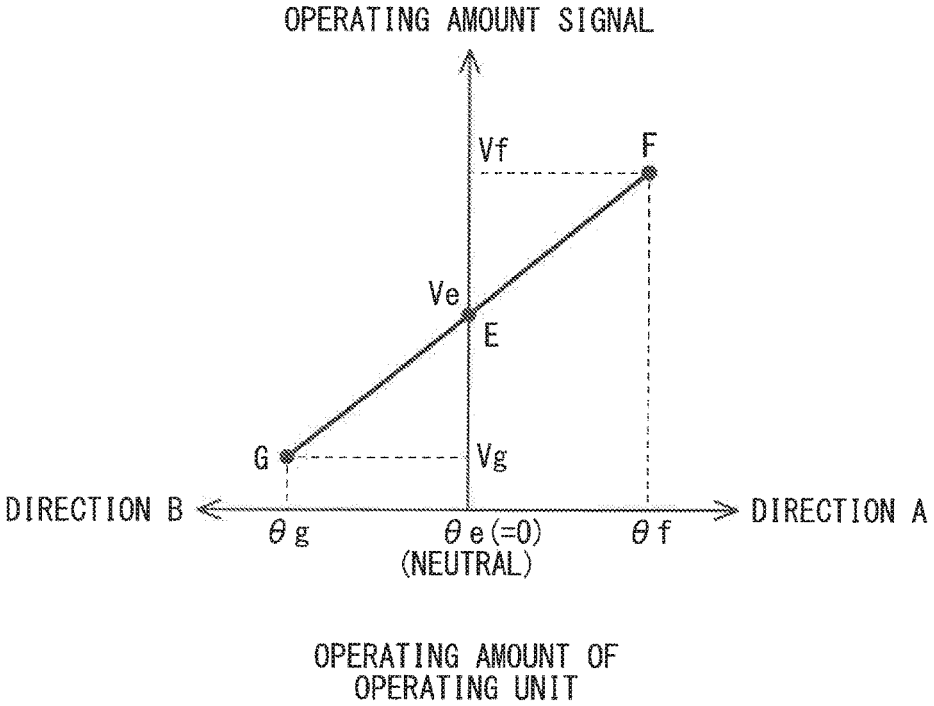
FIG. 3 is a graph showing operating amount signal actual measurement information contained in a second bar code.

In the present embodiment, as shown in FIG. 3, the operating amount detection sensor 23 outputs an operating amount signal that linearly increases from one end to the other end of the movable range of the lever, which is the operating unit 21. Specifically, in a case where the lever is inclined from the neutral position in the one direction, the operating amount signal outputted from the operating amount detection sensor 23 increases in accordance with increase in the inclination angle of the lever. In a case where the lever is inclined from the neutral position in the reverse direction, the operating amount signal outputted from the operating amount detection sensor 23 decreases in accordance with increase in the inclination angle of the lever. It should be noted that, in a case where two operating amount detection sensors 23 are provided, one of the operating amount detection sensors 23 may output an operating amount signal only when the lever is inclined from the neutral position in the one direction, and the other operating amount detection sensor 23 may output an operating amount signal only when the lever is inclined from the neutral position in the reverse direction.

Returning to FIG. 1, in the present embodiment, a first bar code 31 and a second bar code 32 are provided on the pilot valve 22 of the operation device 1. For example, each of the first bar code 31 and the second bar code 32 is a matrix two-dimensional code (QR code (registered trademark)).

The first bar code 31 and the second bar code 32 may be marked on respective labels, and the labels may be attached to the pilot valve 22. Alternatively, the first bar code 31 and the second bar code 32 may be printed on respective stickers, and the stickers may be affixed to the pilot valve 22.

Figure 2:
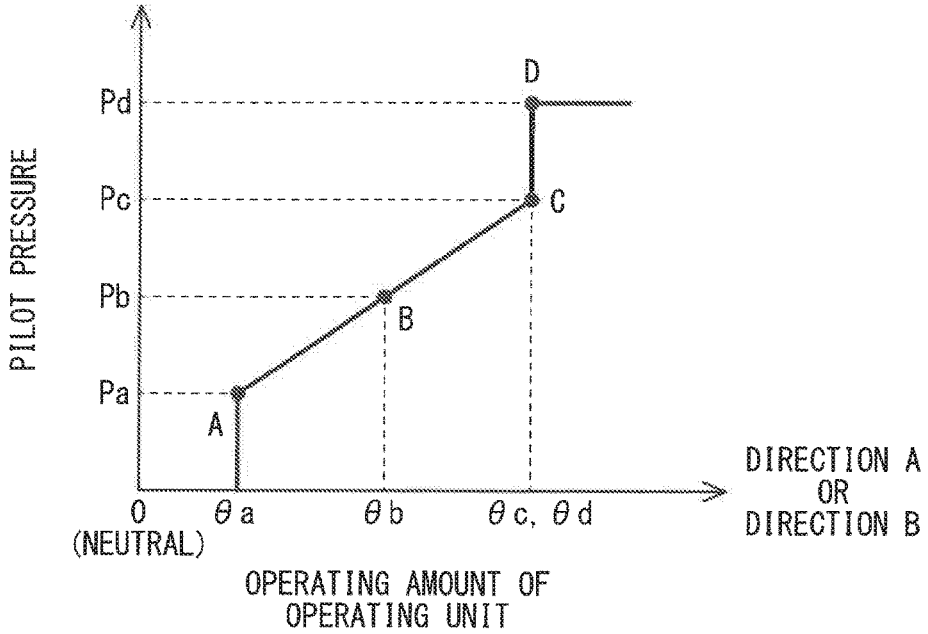
FIG. 2 is a graph showing pilot pressure actual measurement information contained in a first bar code.

The first bar code 31 contains pilot pressure actual measurement information as shown in FIG. 2 for each of the inclination directions (the one direction and the reverse direction mentioned above) of the lever, which is the operating unit 21. The pilot pressure actual measurement information contains a plurality of actual measurement points, and indicates a relationship between the operating amount of the operating unit 21 and the actual measurement value of the pilot pressure outputted from the pilot valve 22. In the example shown in FIG. 2, the pilot pressure actual measurement information contains four actual measurement points A to D. For example, the first actual measurement point A represents: an actual measurement value θa of the operating amount (inclination angle) when the pilot pressure is first outputted as a result of inclining the lever, which is the operating unit 21; and an actual measurement value Pa of the pilot pressure at the time. It should be noted that the number of actual measurement points may be suitably selected.

The second bar code 32 contains operating amount signal actual measurement information as shown in FIG. 3 for both the inclination directions of the lever, which is the operating unit 21. The operating amount signal actual measurement information contains a plurality of actual measurement points, and indicates a relationship between the operating amount of the operating unit 21 and the actual measurement value of the operating amount signal outputted from the operating amount detection sensor 23. In the example shown in FIG. 3, the operating amount signal actual measurement information contains three actual measurement points E, F, and U For example, the first actual measurement point E represents: a specific operating amount (inclination angle) θe (=0) when the lever, which is the operating unit 21, is in the neutral position; and an operating amount signal Ve at the time. It should be noted that the number of actual measurement points may be suitably selected.

The above-described pump 5 is a variable displacement pump. The discharge flow rate of the pump 5 is controlled by electrical positive control. Specifically, the discharge flow rate of the pump 5 is adjusted by a flow rate adjuster 51.

The pump 5 may be a swash plate pump, or may be a bent axis pump. For example, in a case where the pump 5 is a swash plate pump, the flow rate adjuster 51 includes: a regulator that swings the swash plate of the pump 5; and a solenoid proportional valve that outputs a secondary pressure to the regulator.

The flow rate adjuster 51 is electrically connected to a controller 8. The controller 8 is also electrically connected to the operating amount detection sensor 23 of the operation device 1. The controller 8 controls the flow rate adjuster 51 based on the operating amount signal outputted from the operating amount detection sensor 23. To be more specific, the controller 8 controls the flow rate adjuster 51 such that, the greater the operating amount signal outputted from the operating amount detection sensor 23, i.e., the greater the inclination angle of the lever, which is the operating unit 21, the higher the discharge flow rate of the pump 5.

At the time of assembling the machine (construction machine or industrial machine), the controller 8 is also electrically connected to a bar code reader 9. The bar code reader 9 is intended for reading the first bar code 31 and the second bar code 32 provided on the pilot valve 22 of the operation device 1. The reading of the first bar code 31 and the second bar code 32 by the bar code reader 9 is performed manually or automatically. Based on the first bar code 31 and the second bar code 32 read by the bar code reader 9, the controller 8 generates a map for modifying the operating amount signal outputted from the operating amount detection sensor 23, such that the relationship between the operating amount of the operating unit 21 and the pilot pressure outputted from the pilot valve 22 is as designed. The controller 8 stores the generated map in a storage device (not shown).

After the assembling of the machine is completed, when the operation device 1 is actually operated, the controller 8 performs, at any time, conversion (arithmetic operation) of the operating amount signal outputted from the operating amount detection sensor 23 based the prestored map, and controls the flow rate adjuster 51 based on the converted signal.

As described above, the operation device 1 of the present embodiment is capable of modifying the operating amount signal outputted from the operating amount detection sensor 23 based on the actual measurement value of the pilot pressure and the actual measurement value of the operating amount signal once the bar code reader 9 has read the first bar code 31 and the second bar code 32 at the time of assembling of the machine. This makes it possible to correct non-uniformity in the characteristics of the operation device 1 due to manufacturing errors or the like. In addition, since the operating amount detection sensor 23 is the only electronic device that needs to be incorporated in the operation device 1, it is not necessary to install any electronic circuit on the pilot valve 22. Moreover, at the factory setting of the operation device, adjusting the mounting angle of the operating amount detection sensor 23 relative to the pilot valve 22 (specifically, for example, adjusting the mounting angle such that the operating amount detection sensor 23 outputs a predetermined operating amount signal when the pilot valve 22 is in the neutral position) is unnecessary, which makes it possible to provide the operation device 1 at low cost.

(Variations)

The present invention is not limited to the above-described embodiment. Various modifications can be made without departing from the spirit of the present invention.

For example, desirably, at least one of the first bar code 31 and the second bar code 32 contains reading error prevention information for preventing an error when the at least one of the first bar code 31 and the second bar code 32 is read by the bar code reader 9. This configuration makes it possible to prevent an error when the at least one of the first bar code 31 and the second bar code 32 is read by the bar code reader 9 even if the at least one of the first bar code 31 and the second bar code 32 is unclear due to, for example, smudges thereon.

Figure 4:
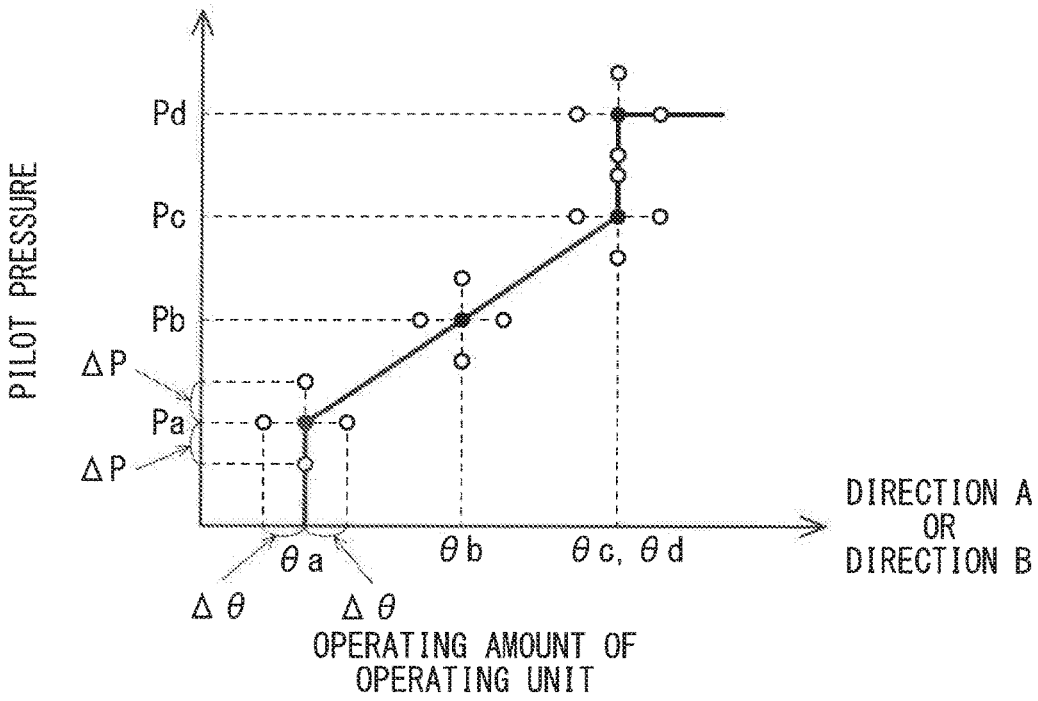
FIG. 4 is a graph showing pilot pressure actual measurement information and reading error prevention information contained in the first bar code.

For example, as shown in FIG. 4, the reading error prevention information may contain a plurality of imaginary points set around each of the plurality of actual measurement points. For example, for the first actual measurement point A (θa, Pa), two imaginary points (θa+Δθ, Pa) and (θa−Δθ, Pa), each of which is obtained by adding or subtracting Δθ to or from the actual measurement value θa, and two imaginary points (θa, Pa+ΔP) and (θa, Pa−ΔP), each of which is obtained by adding or subtracting ΔP to or from the actual measurement value Pa, may be set.

From the foregoing description, numerous modifications and other embodiments of the present invention are obvious to a person skilled in the art. Therefore, the foregoing description should be interpreted only as an example and is provided for the purpose of teaching the best mode for carrying out the present invention to a person skilled in the art. The structural and/or functional details may be substantially altered without departing from the spirit of the present invention.

REFERENCE SIGNS LIST

1 operation device
21 operating unit

22 pilot valve
23 operating amount detection sensor
31 first bar code
32 second bar code
4 hydraulic system
5 pump
51 flow rate adjuster
6 control valve
7 actuator
8 controller
9 bar code reader

What is claimed is:

1. An operation device comprising:

an operating unit;

a pilot valve that outputs a pilot pressure corresponding to an operating amount of the operating unit;

an operating amount detection sensor that outputs an operating amount signal corresponding to the operating amount of the operating unit;

a first bar code provided on the pilot valve and containing pilot pressure actual measurement information indicating a relationship between the operating amount of the operating unit and an actual measurement value of the pilot pressure outputted from the pilot valve; and a second bar code provided on the pilot valve and containing operating amount signal actual measurement information indicating a relationship between the operating amount of the operating unit and an actual measurement value of the operating amount signal outputted from the operating amount detection sensor.

2. The operation device according to claim 1, wherein at least one of the first bar code and the second bar code contains reading error prevention information for preventing an error when the at least one of the first bar code and the second bar code is read by a bar code reader.

3. The operation device according to claim 2, wherein each of the pilot pressure actual measurement information and the operating amount signal actual measurement information contains a plurality of actual measurement points, and the reading error prevention information contains a plurality of imaginary points set around each of the plurality of actual measurement points.

4. A hydraulic system comprising:

the operation device according to claim 1;

a control valve that is moved by the pilot pressure outputted from the pilot valve of the operation device;

a variable displacement pump that supplies hydraulic oil to an actuator via the control valve;

a flow rate adjuster that adjusts a discharge flow rate of the pump; and a controller that controls the flow rate adjuster based on the operating amount signal outputted from the operating amount detection sensor of the operation device, wherein the controller generates a map for modifying the operating amount signal outputted from the operating amount detection sensor based on the first bar code and the second bar code that are read by a bar code reader connected to the controller.

5. The hydraulic system according to claim 4, wherein the controller stores the generated map in a storage device, and when the operation device is operated, the controller performs arithmetic operation based on the stored map.

* * * * *